US006510232B2

(12) United States Patent
Frasl

(10) Patent No.: US 6,510,232 B2
(45) Date of Patent: Jan. 21, 2003

(54) ELECTROACOUSTIC TRANSDUCER HAVING DIAPHRAGM WITH COIL MOUNTING PROJECTIONS AND INTERPOSED STABILIZING WALLS

(75) Inventor: Ewald Frasl, Biedermannsdorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 88 days.

(21) Appl. No.: 09/769,183

(22) Filed: Jan. 25, 2001

(65) Prior Publication Data

US 2001/0010725 A1 Aug. 2, 2001

(30) Foreign Application Priority Data

Jan. 27, 2000 (EP) ..... 00890028

(51) Int. Cl.[7] ..... H04R 1/00
(52) U.S. Cl. ..... 381/423; 381/424
(58) Field of Search ..... 381/423, 424, 381/398, 407, 430; 181/171, 172, 173, 164, 165

(56) References Cited

U.S. PATENT DOCUMENTS 3,132,713 A * 5/1964 Seeler
5,581,624 A * 12/1996 Geisenberger et al.
5,625,701 A * 4/1997 Scanlan
6,075,866 A * 7/2000 Frasl et al.
6,178,252 B1 * 1/2001 Frasl et al.

FOREIGN PATENT DOCUMENTS

EP 0876079 A1 11/1998

* cited by examiner

*Primary Examiner*—Sinh Tran
(74) *Attorney, Agent, or Firm*—Steven R. Biren

(57) ABSTRACT

An electroacoustic transducer (1) has a magnet system (7) and a moving coil (15), which is disposed in the air gap (14) of the magnet system (7), and a diaphragm (17) attached to the moving coil (15). The diaphragm (17) has a mounting zone (24) for mounting the moving coil (15), and projections (25) in the mounting zone (24). The diaphragm (17) also has an interspace between every two projections (25), and two stabilizing walls (32, 33), which are inclined with respect to the diaphragm axis (18), are arranged in each interspace and are arranged so as to form a roof shape and are formed so as to project beyond the mounting zone (24) in radial directions.

6 Claims, 2 Drawing Sheets

ELECTROACOUSTIC TRANSDUCER HAVING DIAPHRAGM WITH COIL MOUNTING PROJECTIONS AND INTERPOSED STABILIZING WALLS

BACKGROUND OF THE INVENTION

The invention relates to an electroacoustic transducer and further relates to a diaphragm for use in an electroacoustic transducer.

Such an electroacoustic transducer and such a diaphragm are generally known, for example from the patent document EP 0 876 079. In the known transducer and the known diaphragm the intermediate spaces between the projections in the mounting zone are formed by gaps, which are situated in the mounting zone only, as a result of which the projections and gaps together form exactly a ring. Practical tests have shown that with such a construction the diaphragm of the known transducer is not stable enough, i.e. not stiff enough, in the mounting zone for the moving coil, which may lead to tumbling movements of the moving coil during operation of the known transducer, as a result of which the moving coil may come into contact with parts of the magnet system, which is unfavorable and undesirable.

It is an object of the invention to preclude the aforementioned problems and to provide an improved electroacoustic transducer and an improved diaphragm.

As a result of the provision of the characteristic features in accordance with the invention it is achieved in a simple manner and substantially without any additional cost that a diaphragm in accordance with the invention for an electroacoustic transducer in accordance with the invention has a stable behavior in directions transverse to the diaphragm axis, i.e. also in its mounting zone in which the projections for holding the moving coil, which are separated by gaps, are situated. The stabilizing walls provide a good stabilization of the diaphragm in its mounting zone without the movability in a direction parallel to the transducer axis being affected thereby.

In a transducer in accordance with the invention and a diaphragm in accordance with the invention it has proved to be very advantageous when, in addition, the stabilizing walls are arrange as a gable roof. Such a construction has the advantage that it is particularly simple and easy to manufacture.

In a transducer in accordance with the invention and a diaphragm in accordance with the invention it has proved to be very advantageous when, in addition, the stablizing walls are arranged as a through-shaped roof. Such a construction guarantees a good stabilization and simple manufacture.

The above-mentioned as well as further aspects of the invention will become apparent from the embodiment described hereinafter by way of example and will be elucidated with reference to this example.

BRIEF DESCRIPTION OF THE DRAWING

The invention will now be described in more detail with reference to the drawings, which show an embodiment given by way of example but to which the invention is not limited.

DESCRIPTION OF THE PREFERRED EMBODIMENTS

Figure 1:
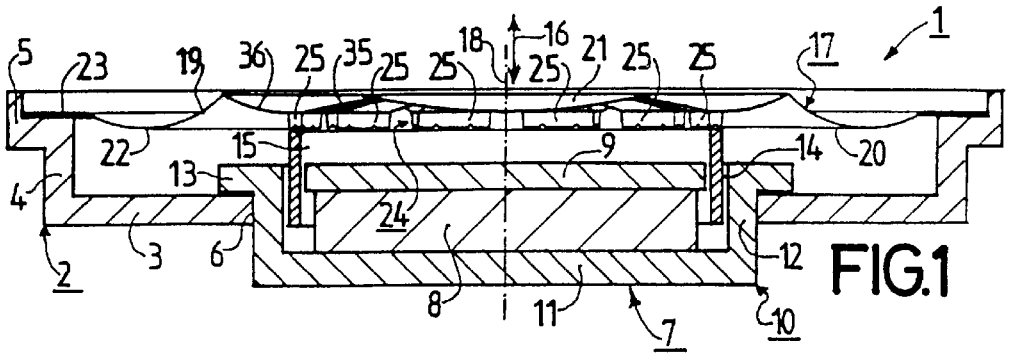
FIG. 1 is a partly diagrammatic cross-sectional view to a scale larger than full scale, which shows an electroacoustic transducer in accordance with an embodiment of the invention, which transducer is constructed as a loudspeaker and includes a diaphragm in accordance with an embodiment of the invention.
Figure 2:
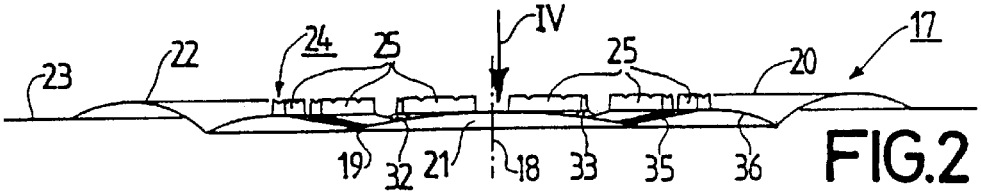
FIG. 2 shows the diaphragm of the transducer of FIG. 1 in a position which is inverted with respect to FIG. 1.
Figure 3:
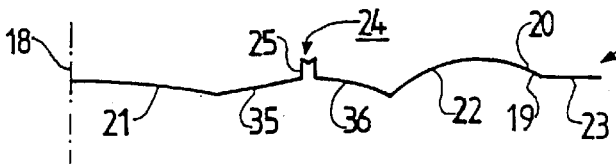
FIG. 3 shows the profile of the diaphragm shown in FIG. 2.
Figure 4:
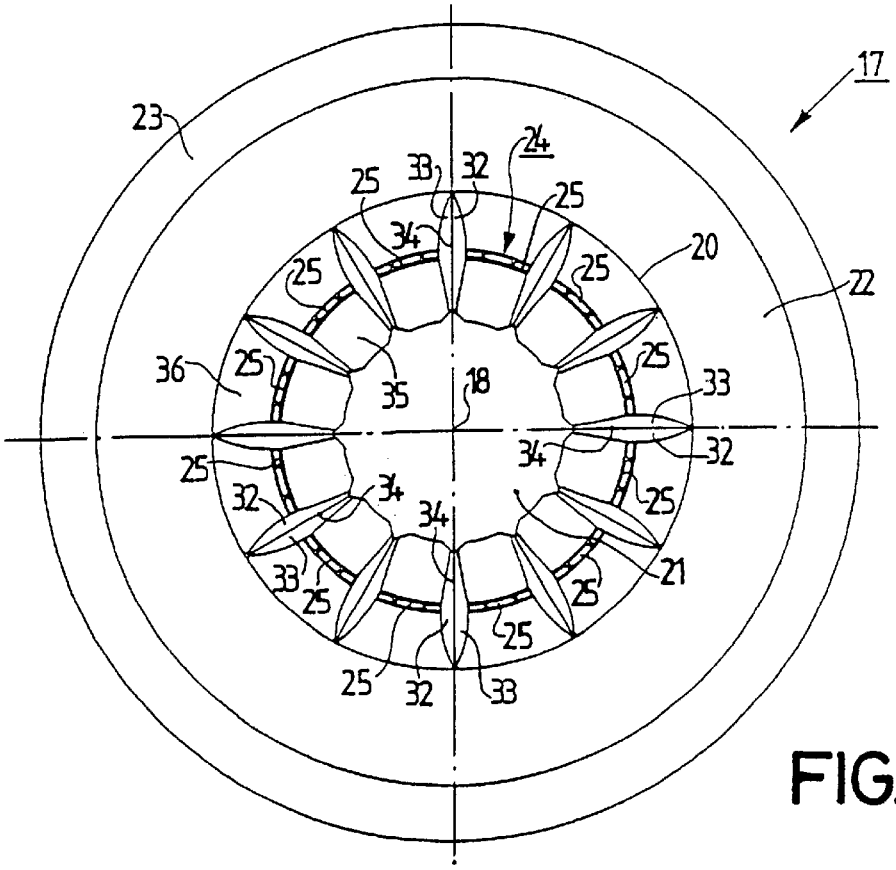
FIG. 4 shows the diaphragm of FIG. 2 in an underneath view taken in accordance with the arrow IV in FIG. 2.
Figure 5:
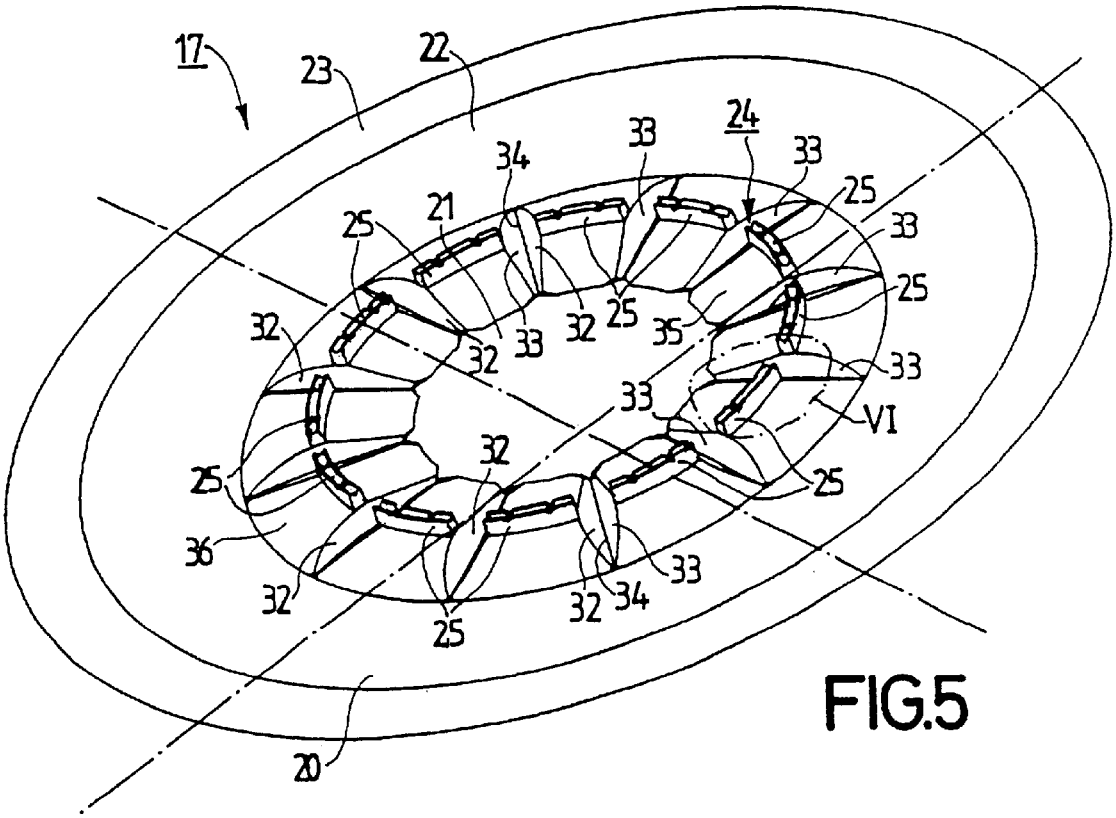
FIG. 5 shows the diaphragm of FIGS. 2 and 4 in an oblique underneath view.

FIG. 1 shows a transducer 1. The transducer 1 has a substantially pot-shaped housing 2, which comprises a housing bottom 3, a hollow cylindrical housing wall 4 and a cross-sectionally angular housing rim 5. The housing bottom 3 has a circularly cylindrical passage 6.

The transducer 1 has a magnet system 7. The magnet system 7 consists of a magnet 8, a pole plate 9 and a pot 10, which is often referred to as the outer pot and which consists of a pot bottom 11, a hollow cylindrical pot portion 12, and a pot flange 13 which projects radially from the pot portion 12. By means of the pot flange 13 of the pot 10 the entire magnet system 7 is secured to the housing bottom 3 of the housing 2 in that an adhesive joint is formed between the pot flange 13 and the housing bottom 3. The pot 10 of the magnet system 7 traverses the passage 6 in the housing bottom 3, a mechanically and acoustically sealed connection being provided between the housing bottom 3 and the pot 10, which connection is formed by a press-fit but which may alternatively be formed by, for example, an adhesive joint.

Between the circumferential bounding surface of the pole plate 9 and the end portion of the hollow cylindrical pot portion 12, which end portion faces the pole plate 9, an air gap 14 is formed. A moving coil 15 of the transducer 1 is disposed partly in the air gap 14. By means of the magnet system 7 the moving coil 15 can be set into vibration in a direction substantially parallel to a direction of vibration, indicated by a double arrow 16 in FIG. 1. The moving coil 15 is connected to a diaphragm 17 of the transducer 1. The construction of the diaphragm 17 is described in detail hereinafter.

The diaphragm 17 is capable of vibration in a direction parallel to a diaphragm axis 18, which also forms a transducer axis of the transducer 1. The diaphragm 17 has a front side 19 and a rear side 20. The diaphragm 17 further has an inner zone 21 which, in the present case, is concave with respect to the acoustic free space situated in front of the front side 19 of the diaphragm 17. As a result of the concave shape of the inner zone 21 a diaphragm 17 having a particularly small overall height is obtained. However, it is also possible to use a diaphragm 17 having an inner zone 21 which is convex with respect to the acoustic free space. Furthermore, the diaphragm 17 has a curved outer zone 22, which adjoins a plane annular peripheral zone 23. The diaphragm 17 is connected to the housing rim 5 by means of the peripheral zone 23, which is effected by means of an adhesive joint. However, instead of an adhesive joint it is possible to use an ultrasonic weld. The diaphragm 17 has a mounting zone 24 between the inner zone 21 and the outer zone 22. The mounting zone 24 serves and is constructed for mounting the moving coil 15. The diaphragm 17 a total of twelve (12) equi-angularly spaced projections 25 in the mounting zone 24. The projections 25 project from the rear side 20 of the diaphragm 17. The moving coil 15 is attached to the projections 25, namely by means of adhesive joints.

Figure 6:
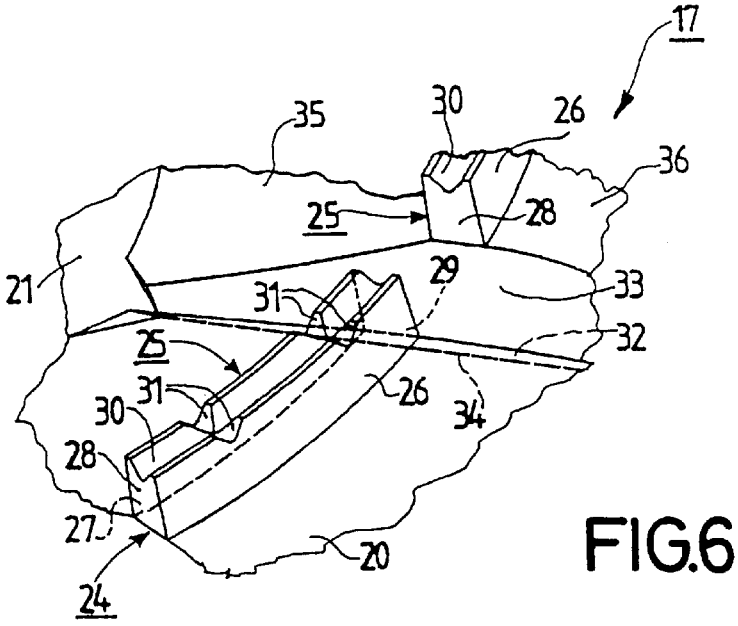
FIG. 6 shows a portion of the diaphragm of FIGS. 2, 4 and 5, which portion is marked by a dash-dot line VI in FIG. 5.

As can be seen in FIG. 6, each projection 25 has an outer long side wall 26 and an inner long side wall 27 as well as two short side walls 28 and 29 and a bottom wall 30, which in the present case is cross-sectionally V-shaped. In total four V-shaped notches 31 are provided in the transitional area between the bottom wall 30 and the two long side walls 26 and 27. The V-shape of the bottom wall 30 is chosen because this has a positive influence on the application and adhesion of an adhesive by means of which the moving coil 15 is attached to the projections 25. During the formation of the adhesive joint any surplus adhesive can escape through the notches 31. It is to be noted that the projections 25 formed by means of the two long side walls 26 and 27, the two short side walls 28 and 29, and the bottom wall 30 have a substantially crenellated or trough shape and are open at their sides which face the front side 19 of the diaphragm 17. This shape of the projections 25 is obtained in that the diaphragm 17 is formed by means of a deep-drawing process.

As can be seen in the Figures, the diaphragm 17 has an interspace between two projections 25. In the area of each of the interspaces two stabilizing walls 32 and 33 are disposed, which stabilizing walls are inclined with respect to the diaphragm axis 18. The two stabilizing walls 32 and 33 in each interspace are arranged in a roof-shape, the stabilizing walls 32 and 33 in each interspace of the present diaphragm 17 being arranged as a gable roof, as a result of which the two stabilizing walls 32 and 33 in each interspace adjoin one another directly in a line-shaped ridge 34.

It is emphasized that a diaphragm 17 may alternatively be constructed in such a manner that the stabilizing walls 32 and 33 in each interspace are shaped as a trough and the stabilizing walls 32 and 33 do not adjoin one another directly but a wall which extends substantially transversely to the transducer axis 18 is interposed between the two stabilizing walls 32 and 33.

In the present diaphragm 17 having two stabilizing walls 32 and 33 arranged as a gable roof in each interspace the two stabilizing walls 32 and 33 extend radially beyond the mounting zone 24 and the stabilizing walls 32 and 33 project from the mounting zone 24 up to the inner zone 21 via an inner intermediate zone 35 and up to the outer zone 22 via an outer intermediate zone 36. Thus, the stabilizing walls 32 and 33 are disposed not only within the mounting zone 24 but for a substantial part they extend also beyond the mounting zone 24 up to the inner zone 21 and up to the outer zone 22.

Owing to the described construction of the diaphragm 17 having radially extending stabilizing walls 32 and 33 arranged in the interspaces between the projections 25 for attaching and holding the moving coil 15 and extending in radial directions away from the projections 25, it is guaranteed that, even in the mounting zone 24 of the diaphragm 17, the diaphragm 17 has a stable behavior in directions transverse to the diaphragm axis 18, i.e. in radial directions. This is because the stabilizing walls 32 and 33 provide a high stability of the diaphragm 17 in its mounting zone 24 but the stabilizing walls 32 and 33 hardly affect the ability of the diaphragm 17 to vibrate in a direction parallel to the diaphragm axis 18.

What is claimed is:

1. An electroacoustic transducer having a magnet system including an air gap, and having a moving coil, which is disposed partly in the air gap of the magnet system, and having a diaphragm, which is capable of vibrating parallel to a diaphragm axis and which has a front side and a rear side and an inner zone and an outer zone as well as an annular mounting zone which is situated between the inner zone and the outer zone and which serves for mounting the moving coil, the diaphragm having projections in the mounting zone, which projections project from the rear side of the diaphragm and to which projections the moving coil is attached, the diaphragm having an interspace between every two projections, wherein two stabilizing walls, which are inclined with respect to the diaphragm axis, are arranged in the area of each interspace, and the two stabilizing walls in each interspace are arranged so as to form a roof shape, and the stabilizing walls are formed so as to project beyond the mounting zone in radial directions.

2. An electroacoustic transducer as claimed in claim 1, wherein the two stabilizing walls in each interspace are arranged as a gable roof.

3. An electroacoustic transducer as claimed in claim 1, wherein the two stabilizing walls in each interspace are arranged as a trough-shaped roof.

4. A diaphragm for an electroacoustic transducer, which diaphragm is capable of vibrating parallel to a diaphragm axis and which has a front side and a rear side and an inner zone and an outer zone as well as an annular mounting zone which is situated between the inner zone and the outer zone and which serves for mounting a moving coil, the diaphragm having projections in the mounting zone, which projections project from the rear side of the diaphragm and to which projections the moving coil is attached, the diaphragm having an interspace between every two projections, wherein two stabilizing walls, which are inclined with respect to the diaphragm axis, are arranged in the area of each interspace, and the two stabilizing walls in each interspace are arranged so as to form a roof shape, and the stabilizing walls are formed so as to project beyond the mounting zone in radial directions.

5. A diaphragm as claimed in claim 4, wherein the two stabilizing walls in each interspace are arranged as a gable roof.

6. A diaphragm as claimed in claim 4, wherein the two stabilizing walls in each interspace are arranged as a trough-shaped roof.

* * * * *